US006133685A

United States Patent [19]

Konda et al.

[11] Patent Number: 6,133,685

[45] Date of Patent: Oct. 17, 2000

[54] CATHODE-RAY TUBE

[75] Inventors: Masahiko Konda; Hideharu Omae; Nozomu Arimoto, all of Osaka, Japan

[73] Assignee: Matsushita Electronics Corporation, Osaka, Japan

[21] Appl. No.: 09/065,327

[22] Filed: Apr. 23, 1998

[51] Int. Cl.[7] ..... H01J 29/58

[52] U.S. Cl. ..... 313/456; 313/412; 313/414; 313/450

[58] Field of Search ..... 313/456, 412, 313/414, 444, 446, 450, 451, 449

[56] References Cited

U.S. PATENT DOCUMENTS

| | | | |
|---|---|---|---|
| 4,797,593 | 1/1989 | Saito et al. . | |
| 4,814,670 | 3/1989 | Suzuki et al. . | |
| 4,886,999 | 12/1989 | Yamane et al. . | |
| 4,945,283 | 7/1990 | Van Der Heijden et al. | 313/456 X |
| 4,945,284 | 7/1990 | Shimoma et al. . | |
| 5,519,290 | 5/1996 | Sugawara et al. . | |
| 5,675,211 | 10/1997 | Ueda . | |
| 5,773,925 | 6/1998 | Kimura et al. | 313/412 X |
| 5,831,399 | 11/1998 | Ohta et al. . | |
| 5,942,847 | 8/1999 | Roth | 313/456 |

FOREIGN PATENT DOCUMENTS

| | | |
|---|---|---|
| 0 646 944 A2 | 4/1995 | European Pat. Off. . |
| 55-21832 | 2/1980 | Japan . |
| 55-141051 | 11/1980 | Japan . |
| 59-111237 | 6/1984 | Japan . |
| 61-99249 | 5/1986 | Japan . |
| 1-232643 | 9/1989 | Japan . |
| 2-106855 | 4/1990 | Japan . |
| 3-93135 | 4/1991 | Japan . |
| 3-95835 | 4/1991 | Japan . |
| 3-233839 | 10/1991 | Japan . |
| 3-283236 | 12/1991 | Japan . |
| 7-6707 | 1/1995 | Japan . |
| 7-6709 | 1/1995 | Japan . |
| 7-226170 | 8/1995 | Japan . |
| 8-22779 | 1/1996 | Japan . |

*Primary Examiner*—Ashok Patel
*Attorney, Agent, or Firm*—Merchant & Gould P.C.

[57] ABSTRACT

In a cathode-ray tube, a nonmetallic material such as ceramic or the like is used for an electrode 1*a* part of an electron gun. Consequently, the deterioration of the efficiency of modulation of electron beam trajectories by an eddy current generated at the metallic electrode part of the electron gun in the high-frequency magnetic fields and the heat generation at the electrode can be decreased. The generation of the eddy current by high-frequency magnetic fields by a convergence yoke or the like can be restrained by using a nonmetallic material for the electrode part of the electron gun. Consequently, the efficiency of modulation of electron beam trajectories is not deteriorated also in a high-frequency modulation zone and the heat generation at the electrode part can be also restrained. Less deterioration of efficiency of modulation of electron beam trajectories by the alternating magnetic fields occurs even in the high-frequency modulation zone, for example, more than 100kHz. Therefore, an excessive power is not required in a deflecting yoke, a convergence yoke, a velocity modulation coil or the like, even in a cathode-ray tube that modulates electron beam trajectories at high frequency in a high definition television or the like. As a result, the damage to a neck portion of a cathode-ray tube caused by heat generation at the electrode part also can be prevented.

10 Claims, 6 Drawing Sheets

CATHODE-RAY TUBE

FIELD OF THE INVENTION

This invention relates to a cathode-ray tube used in a television or a computer-display.

BACKGROUND OF THE INVENTION

Conventionally, the trajectory of an electron beam is generally modulated by an alternating magnetic field generated by a deflecting yoke, a convergence yoke, a velocity modulation coil or the like before the electron beam emitted from a cathode reaches the screen in a cathode-ray tube.

The deflecting yoke generally is provided at a funnel cone portion of a cathode-ray tube. A phosphor screen in the cathode-ray tube is scanned with an electron beam by deflecting trajectories of the electron beam with an alternating magnetic field generated by the deflecting yoke.

The convergence yoke generally is provided outside of a neck of a cathode-ray tube. The raster distortion is corrected by modulating trajectories of an electron beam with an alternating magnetic field generated by the convergence yoke.

The velocity modulation coil generally is provided outside of a neck of a cathode-ray tube and has a function of making a picture image sharp by preventing the runover of a high brightness portion into a low brightness portion on the phosphor screen by modulating the scanning speed of an electron beam with an alternating magnetic field generated by the velocity modulation coil.

An electrode of an electron gun is positioned between an electron beam and a coil for modulating such electron beam trajectories in a magnetic field at high frequency. Generally, a metallic material having high conductivity such as stainless steel or the like has been used as an electrode material for the electron gun for the purpose of forming an electron lens by applying voltage. The sheet resistivity is, for example, about 2mΩ/□ in stainless steel SUS304 having a thickness of 0.4 mm.

FIG. 6 shows a structural example of an electron gun portion in a projection monochrome cathode-ray tube as a conventional cathode-ray tube. An anodic electrode 1 is made of stainless steel. In this example, the center of a magnetic field of a convergence yoke 8 is positioned 7 mm apart from the end of a phosphor screen side of the anodic electrode 1. Most of alternating magnetic fields 9 generated by the convergence yoke 8 pass through the anodic electrode 1. A deflecting yoke 16 is provided at a funnel cone portion of the cathode-ray tube. A part of alternating magnetic fields 17 generated by the deflecting yoke 16 passes through the anodic electrode 1 and a cylinder 15 shielding a getter. A velocity modulation coil 18 is arranged in the middle of a pre-anodic electrode 3 and a focusing electrode 2. Most of alternating magnetic fields 19 generated by the velocity modulation coil 18 pass through the pre-anodic electrode 3 and the focusing electrode 2.

When the alternating magnetic fields are generated through such metallic electrodes, an eddy current is generated at the parts of the metallic electrodes. The eddy current loss becomes greater as the frequency of the alternating magnetic fields becomes higher. Consequently, the modulation effect on the electron beam trajectories by the magnetic fields decreases in the high-frequency modulation area.

In the conventional example shown in FIG. 6, for example, a modulation effect on electron beam trajectories by the convergence yoke 8 decreases, since an eddy current is generated at the anodic electrode 1 by the alternating magnetic fields 9 generated by the convergence yoke 8.

In some cases, the electrode is heated by this eddy current loss, thus damaging the neck of the tube. In the case of designing a cathode-ray tube so that the distance between a source of alternating magnetic fields and a metallic electrode of an electron gun is made great in order to prevent such a loss in alternating magnetic fields and heat generation at an electrode, the distance between an electron-beam focusing lens and a phosphor screen becomes inevitably greater and the magnifying power of an electron lens becomes therefore greater. Consequently, there is a problem of decreasing resolution. Particularly, the loss in such alternating magnetic fields becomes greater in a picture display unit having a high deflecting frequency and a wide signal zone such as a high definition television or the like, resulting in hindrance in practical use.

SUMMARY OF THE INVENTION

The object of the present invention is to provide a cathode-ray tube in which a loss in alternating magnetic fields and heat generation at an electrode are decreased in order to solve the conventional problem mentioned above.

In order to achieve the object mentioned above, a cathode-ray tube according to the present invention comprises a glass panel portion having a phosphor screen on its inner surface, a glass funnel portion connected to the back end of the glass panel portion and a neck portion provided with an electron gun in its inside. The cathode-ray tube is characterized in that a nonmetallic material is used for an electrode part of the electron gun.

The configuration mentioned above can prevent the generation of an eddy current by high-frequency magnetic fields generated by a coil for modulating electron beam trajectories in the magnetic fields at high frequency. In the configuration mentioned above, the efficiency of modulation of the electron beam trajectories is not deteriorated even in a high-frequency modulation zone and heat generation at the electrode part also can be prevented.

In the cathode-ray tube mentioned above, it is preferable that the nonmetallic material of the electrode part of the electron gun is a resistance material having a sheet resistivity of 20mΩ/□–100GΩ/□.

In the case where the sheet resistivity is less than 20mΩ/□, the effect cannot be obtained sufficiently. In the case where the sheet resistivity is more than 100 GΩ/□, the electric field becomes unstable by being charged and the electron lens effect is changed as time elapses, resulting in a harmful effect such as the change of a shape of an electron beam spot on a phosphor screen as time elapses.

In the cathode-ray tube, it is also preferable that the nonmetallic material of the electrode part of the electron gun is ceramic. A material such as conductive alumina ceramic, conductive titania type ceramic, silicone carbide ceramic or the like can be used as a ceramic material. The preferable thickness of the electrode part of the electron gun made of ceramic is in the range of 0.5 mm–2.0 mm. In the case where the thickness is less than 0.5 mm, the material becomes frail and its strength tends to be not suitable in practical use. On the other hand, in the case where the thickness is more than 2.0 mm, it becomes difficult to form electron beam trajectories having high precision, since it is necessary to make an electron lens to be formed inside small. In addition, the cost tends to increase and the workability also tends to become worse.

It is preferable that the nonmetallic material of the electrode part of the electron gun is glass. A cutting step for improving the shape accuracy is not required when using glass, since a glass tube has higher forming accuracy compared to ceramic. Thus, the glass is advantageous in terms of cost.

It is preferable that a layer made of a resistance material is formed in the inner surface of the electrode part of the electron gun for which a nonmetallic material is used. According to the cathode-ray tube as mentioned above, a desired value of resistance can be easily adjusted by forming a layer made of a resistance material.

It is preferable that the layer made of a resistance material is formed of a glass glaze thick film.

According to the cathode-ray tube as mentioned above, sheet resistivity is stabilized and a film stripping is prevented in a glass glaze thick film, thus obtaining stable quality.

It is preferable that the layer made of a resistance material is formed by evaporating to form a metallic thin film. According to the cathode-ray tube as mentioned above, a calcination process is not required, thus simplifying the evaporation process of a resistive layer.

It is preferable that a metal component is fixed to the electrode part of the electron gun for which a nonmetallic material is used by using a conductive adhesive. The cathode-ray tube as mentioned above enables the electrical conduction between the electrode part of the electron gun and the metal component.

It is preferable that a metal component is fixed to the electrode part of the electron gun for which a nonmetallic material is used by clamping a pawl formed on the metal component to the electrode part of the electron gun. According to the cathode-ray tube as mentioned above, the assembly process of the electron gun can be simplified.

It is preferable that a metal component is fixed to the electrode part of the electron gun for which a nonmetallic material is used by pressing a spring formed on the metal component against the electrode part of the electron gun. According to the cathode-ray tube as mentioned above, the assembly process of the electron gun can be simplified.

PREFERRED EMBODIMENTS OF THE INVENTION

Figure 1:
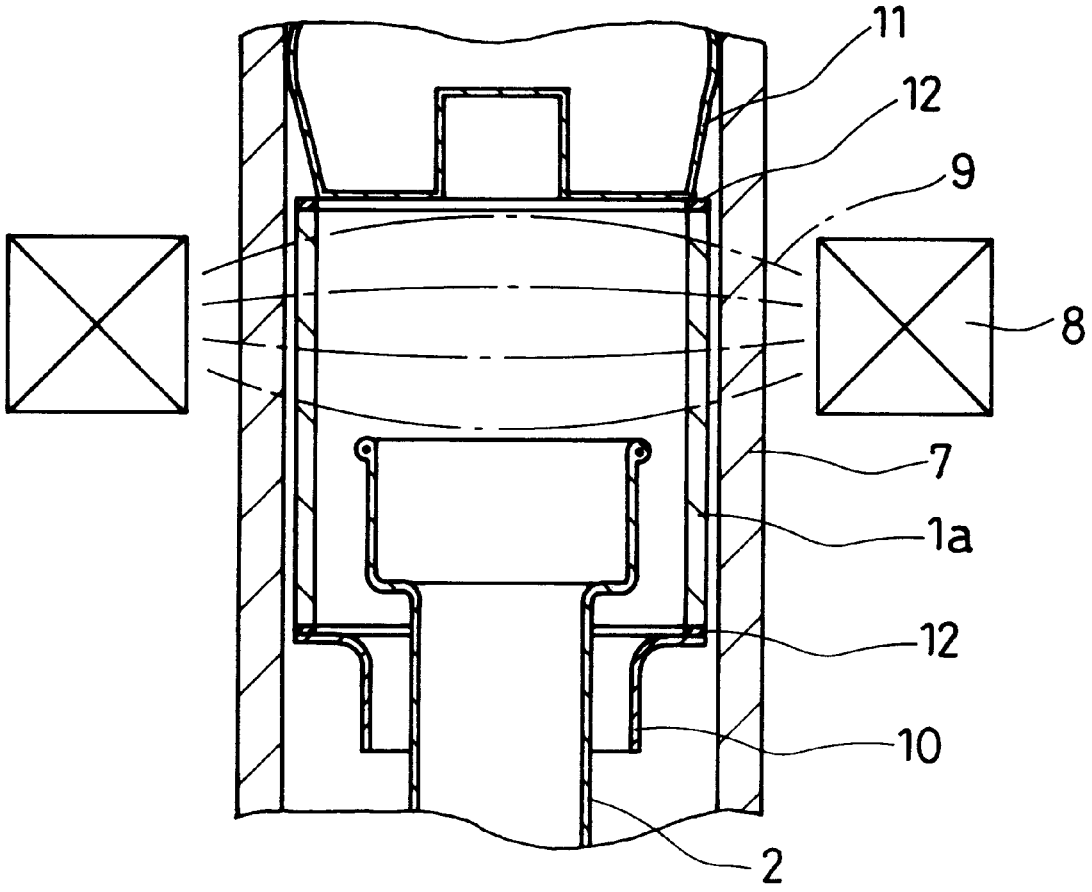
FIG. 1 shows a cross-sectional view illustrating a structural example of an electron gun portion in a monochrome cathode-ray tube that is an embodiment of a cathode-ray tube according to the present invention.

The preferred embodiments according to the present invention will be explained by referring to the drawings as follows.

FIG. 1 shows an electron gun in a projection monochrome cathode-ray tube as a cathode-ray tube of an embodiment according to the present invention.

In FIG. 1, an anodic electrode 1*a* is made of a highly resistive ceramic cylinder (made of alumina ceramic) having an outer diameter of 22 mm, a thickness of 1 mm and a specific resistance of 1 kΩ·cm and has a sheet resistivity of 10 kΩ/□. A focusing electrode 2 made of stainless steel having an inner diameter of 15 mm is positioned inside of the anodic electrode 1*a*. An electron gun comprising these parts is inserted into the inside of the neck of a tube having an outer diameter of 29.1 mm. The numeral 7 indicates the neck portion of the cathode-ray tube.

In this case, the anodic electrode 1*a* is required to be fixed to metallic parts such as a bracket 10 for fixing an electrode having a flange outside diameter of 22 mm, a contact-spring 11 for applying anode potential from a conductive layer applied to the inner surface of the neck in the cathode-ray tube or the like. A conductive adhesive 12 is used for the fixing. For example, an adhesive such as a frit glass in which silver particles are dispersed or the like can be used.

In the case where the adhesive itself has no conductivity, electric conduction can be obtained by applying a conductive coating on the surface.

Since the anodic electrode 1*a* is arranged at the same position as the conventional one, most of alternating magnetic fields 9 generated by a convergence yoke 8 pass through the anodic electrode 1*a*. However, the anodic electrode 1*a* is made of a resistance material, which enables the generation of an eddy current by the alternating magnetic fields 9 to be restrained. Furthermore, the efficiency of modulation of electron beam trajectories is not deteriorated also in a high-frequency modulation zone and the heat generation at the anodic electrode 1*a* can be also restrained.

It is necessary that a resistance material used for an electrode material according to the present invention has a resistance more than a certain level in order to realize the effect mentioned above, while it is also necessary to have a resistance small enough that the electrode itself is not charged. Therefore, the resistance is limited in a certain range.

The effect mentioned above cannot be obtained sufficiently when the sheet resistivity of a resistance material used as an electrode material according to the present invention is smaller than 20 mΩ/□.

In the case where the sheet resistivity is more than 100 GΩ/□, the electric field becomes unstable by being charged and the electron lens effect is changed as time elapses, resulting in a harmful effect such as a change in the shape of an electron beam spot on a phosphor screen as time elapses.

Thus, the sheet resistivity should be in the range of 20 mΩ/□–100 G Ω/□.

Figure 2:
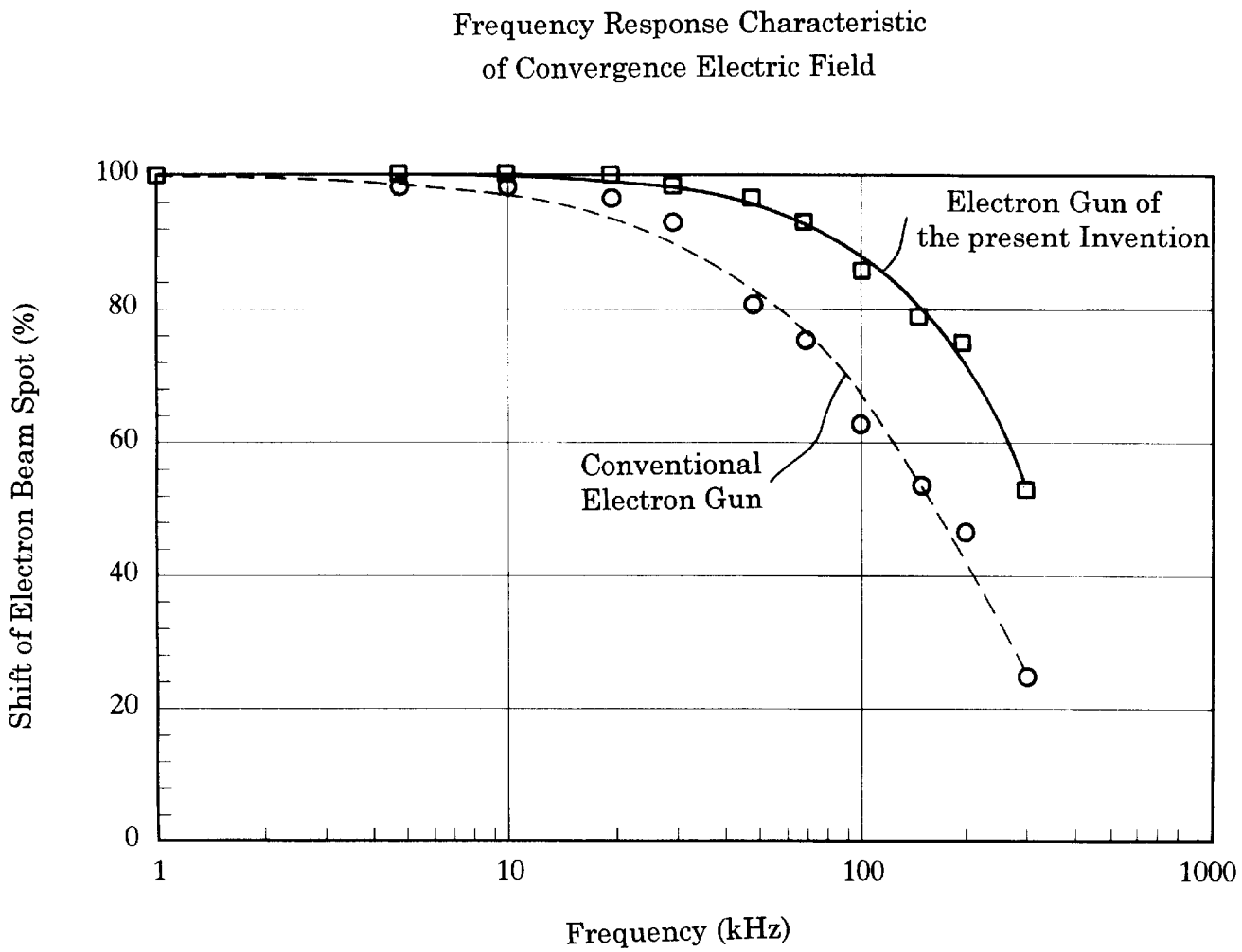
FIG. 2 shows a graph indicating a frequency response characteristic in convergence magnetic fields of an electron gun of an embodiment according to the present invention and of a conventional electron gun.

FIG. 2 shows a result of comparison between the present example and the conventional example in a frequency response characteristic of a convergence magnetic field in a cathode-ray tube. In the case of applying a sinusoidal current of 100 kHz to a convergence yoke, the deflection width of an electron beam, that is the deflection efficiency of an electron beam, on a phosphor screen by convergence yoke magnetic fields is improved to 137% compared to that in the conventional cathode-ray tube.

On the other hand, a heating value Q at an electrode by high-frequency magnetic fields is expressed by the following formula (Formula 1) ($\phi$ is strength of the magnetic field; f is a frequency; and R is a sheet resistivity of an electrode):

Formula 1

$$Q\,\phi^2 f^2/R$$

The resistivity of a conventional metallic electrode part is about 2 m Ω/□ and the resistivity of the electrode part according to the present embodiment is 10 kΩ/□. From the formula 1, the heating value at the anodic electrode according to the present embodiment decreases to $5\times10^{-4}$% compared to that of an example using a conventional metallic electrode.

In the present embodiment, the anodic electrode is made of highly resistive ceramic. However, the same effect can be also obtained by using another resistance material such as, for example, a glass resistor made by impregnating a porous glass with carbon by a gas phase method. Since a glass tube has higher forming accuracy compared to ceramic, a cutting step for improving the shape accuracy is not required. Thus, the glass tube is advantageous in terms of cost.

Figure 5:
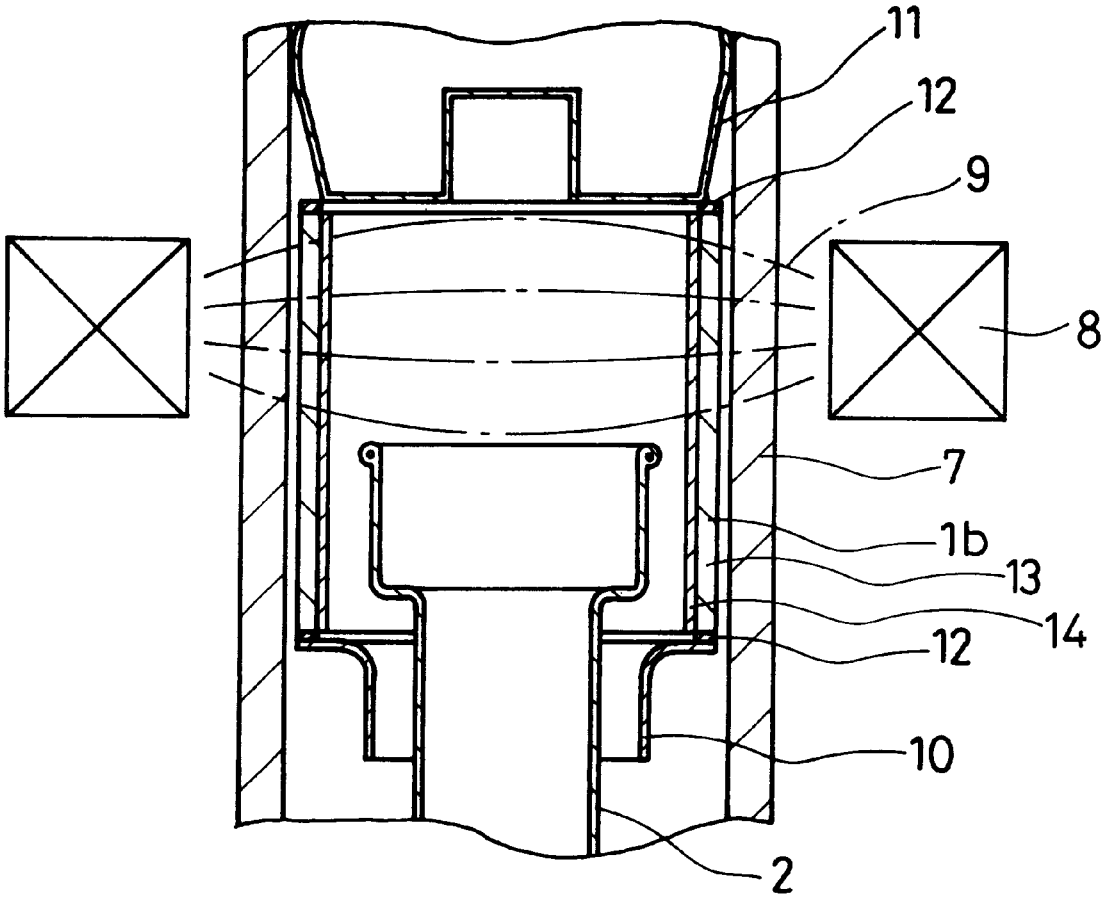
FIG. 5 shows a cross-sectional view illustrating another structural example of an electron gun portion in a monochrome cathode-ray tube in another embodiment according to the present invention.
Figure 6:
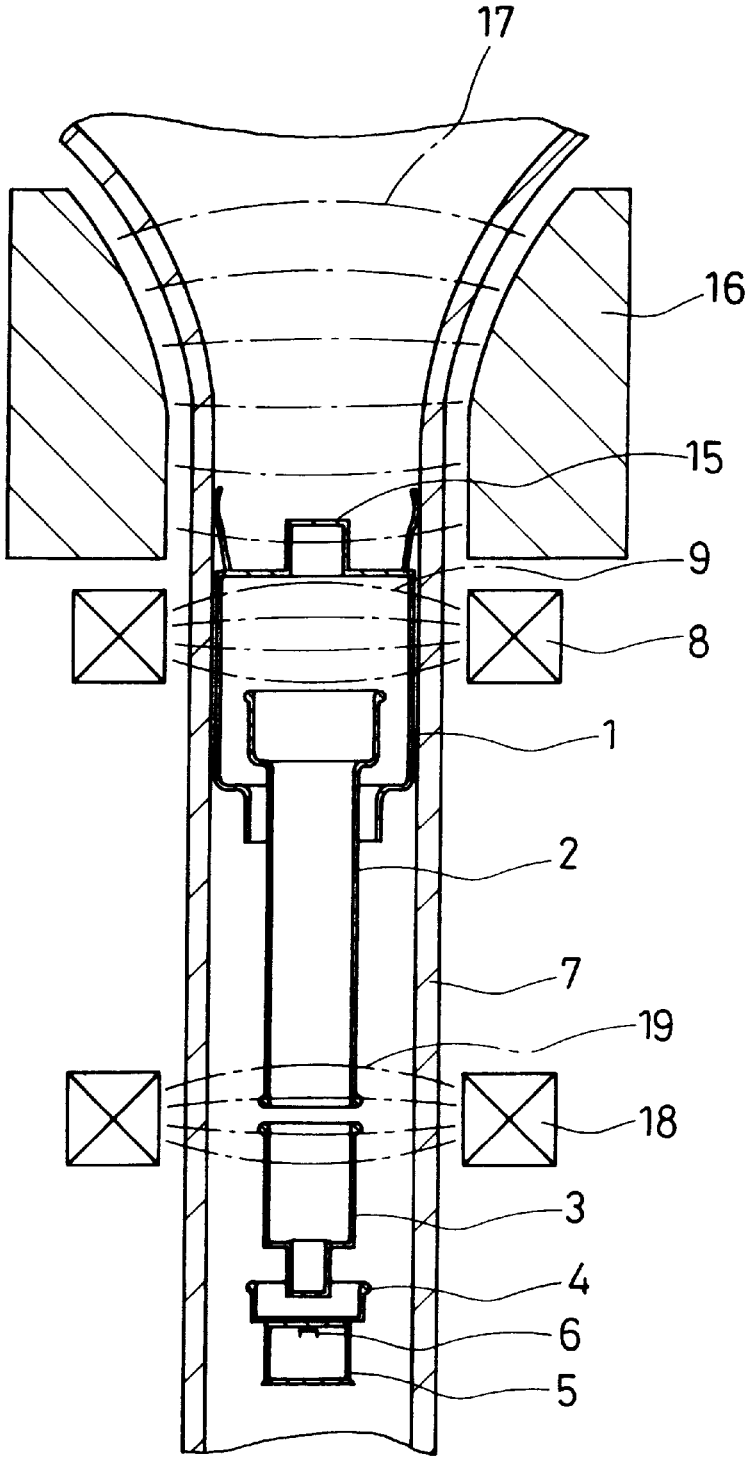
FIG. 6 shows a cross-sectional view illustrating a structural example of an electron gun portion in a monochrome cathode-ray tube as a conventional cathode-ray tube.

FIG. 5 shows another example according to the present invention. In FIG. 5, a ceramic cylinder 13 provided at its inner surface with a layer 14 made of a resistance material having a sheet resistivity of 10 kΩ/□ is used as an anodic electrode 1*b*.

For example, a glass glaze thick film resistor in which conductive materials such as ruthenium oxide or the like are dispersed in a glass paste can be used as a resistance material.

A dip method in which an anodic electrode is dipped into a paste-like resistive material and taken out therefrom, a method of forming a resistive layer directly on the inner wall of an anodic electrode by a dispenser or printing or the like can be considered as a method for the application of a resistance material. In the dip method, it is easy to apply a resistance material to the inner wall of a ceramic cylinder, thus obtaining a high productivity. In the dispenser method or the printing method, uniform application of a resistance material is possible, thus obtaining a stable quality.

In the present embodiment, it is also necessary to fix the anodic electrode to metallic parts such as a bracket 10 for fixing the electrode, a contact-spring 11 for applying anode potential from a conductive layer applied on the inner surface of the neck of a cathode-ray tube or the like as in Embodiment 1. The conductive adhesive 12 in which silver particles are dispersed can be used for the fixing.

In this example, a resistance material is also used for an anodic electrode 1*b*. Therefore, an eddy current generated at the anodic electrode 1*b* by the alternating magnetic field 8 generated by the convergence yoke 8 can be restrained, resulting in less loss of the alternating magnetic field.

The present embodiment comprises a structure in which a resistive layer 14 is provided by applying a resistive agent whose resistance can be adjusted relatively easily on the inner surface of the ceramic cylinder 13 processed by cutting so as to have high accuracy. Consequently, the resistance can be easily adjusted to the desired resistance. The resistance can be easily adjusted by changing the ratio of a conductive material such as ruthenium oxide or the like.

In the present embodiment, ceramic is used as a structure for forming a resistive layer. However, a dielectric material such as a glass tube or the like also can be used. In the case of using the glass tube, a cutting step for improving the form accuracy is not required, since the glass tube has higher molding accuracy compared to ceramic. As a result, the glass tube is advantageous in terms of cost.

The distortion of an electron lens can be prevented by applying a resistive agent also to the part other than the inner surface of a glass tube or a ceramic cylinder when the electron beam trajectories are affected by the distortion of the electron lens, which is caused by the charge at the part not covered with the resistive layer in the glass tube or the ceramic cylinder.

In the present embodiment, a glass glaze thick film resistor is used as a resistive layer. However, it is also possible to form a resistive film by evaporating to form a metallic thin film such as chromium, aluminum or the like on the inner surface of a cylinder. In the case of using this method, the evaporation process of a resistive layer can be simplified, since a calcination process, which is required in the case of using a glass glaze thick film resistor, can be omitted.

Figure 3:
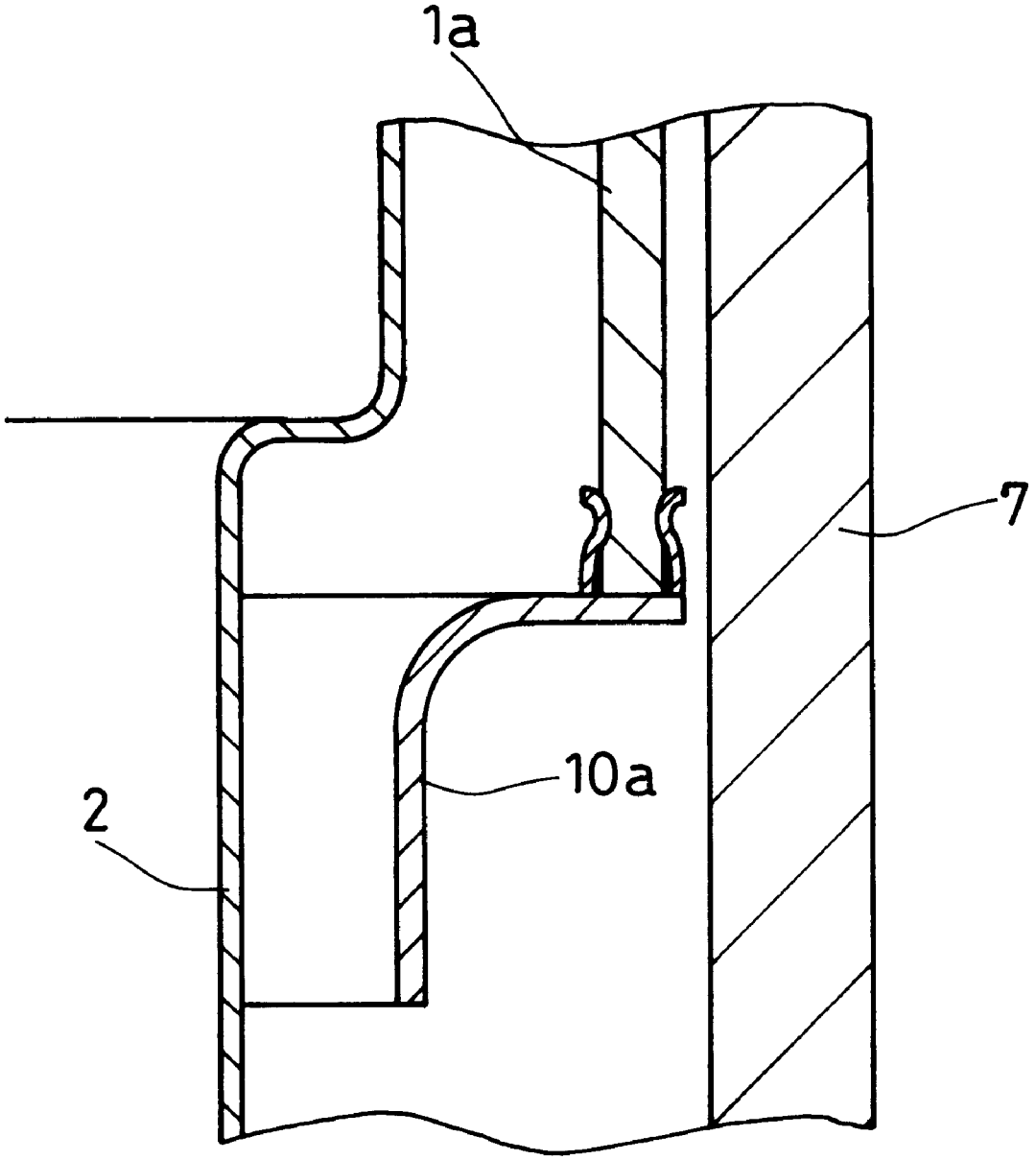
FIG. 3 shows a cross-sectional view illustrating a structural example of a part of an electron gun in which an electrode is fixed by a clamping method in an embodiment according to the present invention.
Figure 4:
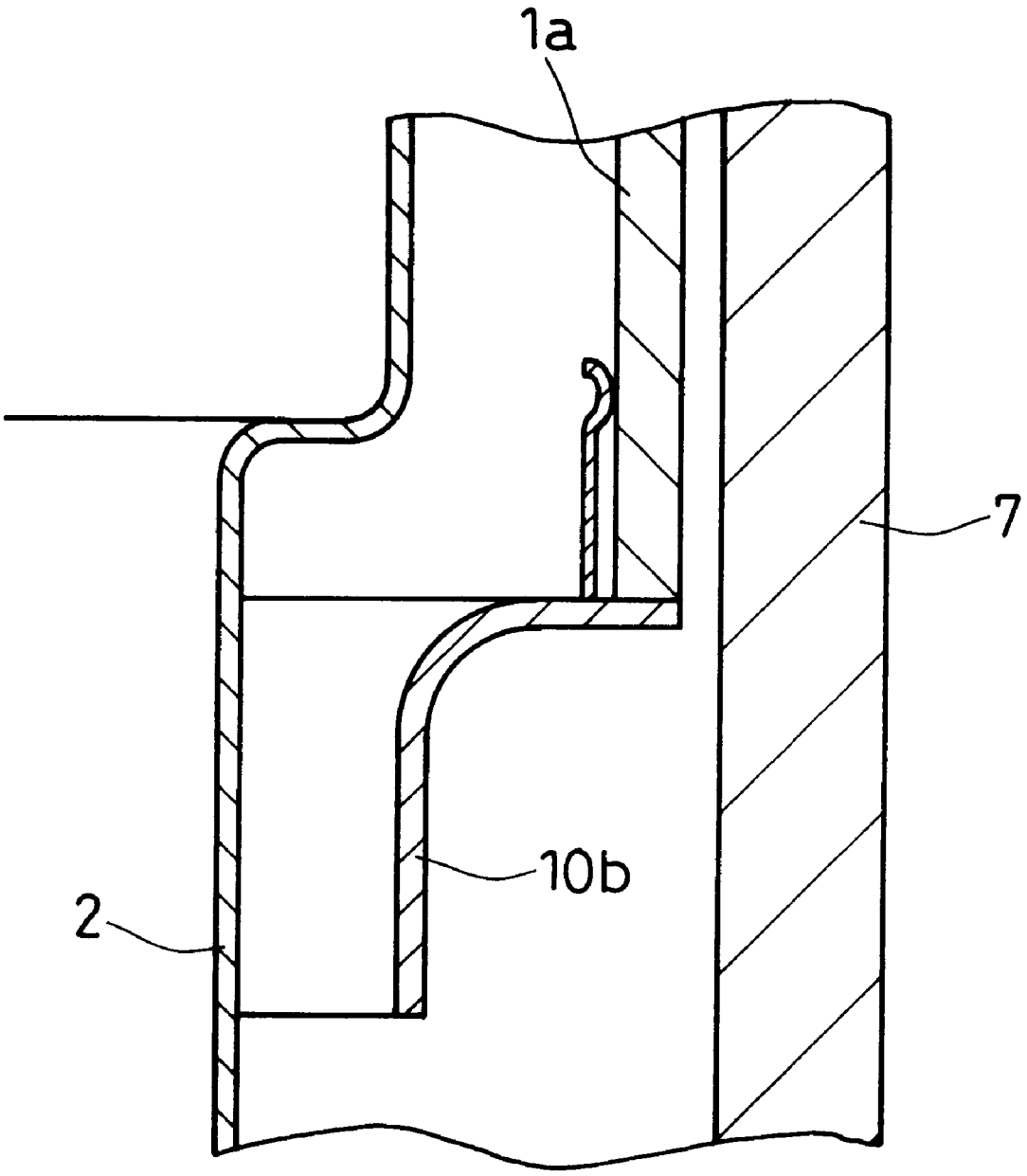
FIG. 4 shows a cross-sectional view illustrating a structural example of a part of an electron gun in which an electrode is fixed by a spring in an embodiment according to the present invention.

In an embodiment according to the present invention, the anodic electrode 1*a* is fixed to the bracket 10 and the contact-spring 11 using the conductive adhesive 12. However, the anodic electrode 1*a* also can be fixed by a clamping method in which the anodic electrode 1*a* is clamped by a pawl of the bracket 10*a* as shown in FIG. 3. As shown in FIG. 4, it is also possible to fix the anodic electrode 1*a* by pressing the spring provided in the bracket 10*b* against the anodic electrode 1*a*. Assembly processes of an electron gun can be simplified by using these methods.

The present invention is used in an unipotential-type electron gun having an electrode structure in which a focusing electrode is arranged inside of an anodic electrode as an embodiment according to the present invention. However, the present invention also can be used in an unipotential-type electron gun in which an ordinary anodic electrode and an opening of a focusing electrode are arranged so as to face each other.

The present invention is used in an unipotential-type electron gun as an embodiment according to the present invention. However, naturally, the present invention also can be used in an electron gun having another structure, for example, a bipotential-type electron gun.

The present invention is used in an anodic electrode as an embodiment according to the present invention. However, the present invention also can be used in other parts of an electron gun formed by using conventional metallic materials such as a control electrode, an accelerating electrode, a focusing electrode, a cylinder shielding a getter or the like.

In that case, the deterioration of the efficiency of modulation of electron beam trajectories by the alternating magnetic field passing through such parts of the electron gun can be prevented as an effect. For example, in the case of using the present invention in a cylinder shielding a getter, the deterioration of the efficiency of modulation of electron beam trajectories by the alternating magnetic field of a deflecting yoke and a convergence yoke can be prevented. In the case of using the present invention in a control electrode, an accelerating electrode and a focusing electrode, the deterioration of the efficiency of modulation of electron beam trajectories by the alternating magnetic field of a velocity modulation coil can be prevented.

In the case mentioned above, the present invention is used in a monochrome cathode-ray tube. However, the same effect can be obtained when using the present invention in a color cathode-ray tube.

Thus, less deterioration of efficiency of modulation of electron beam trajectories by the alternating magnetic field occurs even in the high-frequency modulation zone more than 100kHz. Consequently, an excessive power is not required in a deflecting yoke, a convergence yoke, a velocity modulation coil or the like also in an cathode-ray tube modulating high frequency in a high definition television or the like. The present invention also reduces the chances of damage to a neck portion of a cathode-ray tube caused by heat generation at an electrode.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A cathode-ray tube, comprising:

a glass panel portion having a phosphor screen on its inner surface;

a glass funnel portion connected with the back end of the glass panel portion; and a neck portion, inside of which is provided an electron gun having an electrode part, wherein a portion of the electrode part in which an eddy current is generated with an alternating magnetic field applied from outside is made of a nonmetallic material that is a resistance material with a resistance of 20mΩ/□ to 100GΩ/□.

2. A cathode-ray tube according to claim 1, wherein the nonmetallic material of the electrode part of the electron gun is ceramic.

3. A cathode-ray tube according to claim 2, wherein the thickness of the electrode part of the electron gun made of ceramic is in the range of 0.5 mm–2.0 mm.

4. A cathode-ray tube according to claim 1, wherein the nonmetallic material of the electrode part of the electron gun is glass.

5. A cathode-ray tube according to claim 1, wherein a layer made of a resistance material is formed on an inner surface of the electrode part for which a nonmetallic material is used.

6. A cathode-ray tube according to claim 5, wherein the layer made of a resistance material is formed by a glass glaze thick film.

7. A cathode-ray tube according to claim 5, wherein the layer made of a resistance material is formed by evaporating to form a metallic thin film.

8. A cathode-ray tube according to claim 1, wherein a metal component is provided in the neck portion that is fixed to the electrode part of the electron gun for which the nonmetallic material is used by using a conductive adhesive between the metal component and one end of the electrode part of the electron gun.

9. A cathode-ray tube according to claim 1, wherein a metal component is provided in the neck portion that is fixed to the electrode part of the electron gun for which the nonmetallic material is used by clamping one end of the electrode part of the electron gun in a pawl formed on the metal component.

10. A cathode-ray tube according to claim 1, wherein a metal component is provided in the neck portion that is fixed to the electrode part of the electron gun for which the nonmetallic material is used by pressing a spring formed on the metal component against one end of the electrode part of the electron gun.

* * * * *